United States Patent [19]

Nagasaka

[11] Patent Number: 4,950,032

[45] Date of Patent: Aug. 21, 1990

[54] SEAT HAVING VERTICALLY MOVABLE LUMBER SUPPORT

[75] Inventor: Youetsu Nagasaka, Fujisawa, Japan

[73] Assignee: Shiroki Corporation, Fujisawa, Japan

[21] Appl. No.: 384,371

[22] Filed: Jul. 25, 1989

[30] Foreign Application Priority Data

Mar. 31, 1989 [JP] Japan ..... 1-38045[U]

[51] Int. Cl.[5] ..... A47C 7/40

[52] U.S. Cl. ..... 297/284; 297/374

[58] Field of Search ..... 297/284, 361, 374, 408

[56] References Cited

U.S. PATENT DOCUMENTS 3,880,463 4/1975 Shepard et al. ..... 297/284

4,623,193 11/1986 Lieker ..... 297/284

FOREIGN PATENT DOCUMENTS 696502 10/1964 Canada ..... 297/284

640877 1/1979 U.S.S.R. ..... 297/284

*Primary Examiner*—Peter R. Brown

*Attorney, Agent, or Firm*—Schwartz & Weinrieb

[57] ABSTRACT

Disclosed is a seat for an automobile or the like. The seat includes a seat cushion; a seat back connected to the seat cushion, a space being formed within a lower portion thereof; a rod which is rotatably provided between oppositely disposed side frames of the seat back; a hip support secured to an intermediate portion of the rod and disposed within the space provided within the seat back; an operation handle provided upon either one of the side frames and adapted to rotate the rod by means of a brake mechanism; a pinion to which the rotation of the operation handle is transmitted by means of the a brake mechanism; a support board disposed upon a support plate provided inside the hip support, the support board being vertically movable; and a retaining mechanism for retaining the support board at a specified height.

10 Claims, 7 Drawing Sheets

SEAT HAVING VERTICALLY MOVABLE LUMBER SUPPORT

FIELD OF THE INVENTION

The present invention relates to a seat for an automobile or the like and, more particularly, to a seat having a hip region support for supporting the hip (the lumbar vertebra, L-3 to L-5) of an occupant of a vehicle.

BACKGROUND OF THE INVENTION

Seats of this type are disclosed in Japanese Utility Model Laid-Open Nos. 174462/1986 and 101850/1984.

The former Japanese Utility Model Laid-Open No. 174462/1986 discloses an arrangement in which a space is provided within a lower portion of a seat back, a hip support being accommodated within the space in such a manner as to be forwardly inclinable with its lower portion serving as a fulcrum, and when an occupant assumes a seated position in which his hip region is moved forwardly, the hip support is inclined forwardly so as to project outwardly from a front surface of the seat back, thereby allowing the occupant's hip region to be supported by means of this projecting portion of the seat. With this arrangement, when the occupant feels that the support of his hip region is insufficient, it is necessary for him to rise up and seat himself again after adjustably inclining the hip support still further in the forward direction.

In the latter Japanese Utility Model Laid-Open No. 101850/1984, an arrangement is disclosed in which a space is provided within a lower portion of a seat back, a hip support being disposed within the space in such a manner as to be rotatable back and forth with an upper portion thereof serving as a fulcrum, while a seat plate is connected to a lower portion of this hip support by means of a hinge in such a manner as to be movable back and forth upon a seat cushion. With this arrangement, the occupant is seated upon the seat cushion by means of the seat plate. Accordingly, when he feels that the support of his hip region is insufficient, it is necessary for the occupant to rise up, move the hip support forward by pulling the seat plate in the forward direction, and then seat himself again.

Thus, with the above-described examples of the prior art, if the occupant rises up, he can adjust the position of the hip support in a back and forth mode; however, he cannot make an adjustment in a vertical direction. Although the hip support is designed to engage the lumbar vertebra (L-3 to L-5), the position of the lumbar vertebra (L-3 to L-5) differs depending upon the physical constitution of the occupant. The conventional apparatus therefore has the drawback in that it is impossible to obtain appropriate support for the hip region of the occupant as a function of the physical constitution of the occupant.

OBJECTS OF THE INVENTION

Accordingly, an object of the present invention is to provide a seat which is capable of making adjustments of the vertical position of a hip support, thereby overcoming the above-described drawbacks of the prior art.

Another object of the present invention is to provide a seat which allows an occupant of a vehicle to adjust the position of the hip support while being seated.

SUMMARY OF THE INVENTION

To these ends, in accordance with the present invention, there is provided a seat cushion; a seat back connected to the seat cushion, a space being formed within a lower portion thereof; a rod which is pivotably supported between oppositely disposed side frames of the seat back; a hip support secured to an intermediate portion of the rod and disposed within the space provided within the seat back; an operation handle provided upon either one of the side frames and adapted to pivot the rod by means of a brake mechanism; a pinion to which the rotation of the operation handle is transmitted by means of a brake mechanism a support board disposed upon a support plate provided inside the hip support, the support board being vertically movable; and a retaining mechanism for retaining the support board at a specified height.

BRIEF DESCRIPTION OF THE DRAWINGS

Various other objects, features and advantages of the present invention will become more apparent from the following detailed description of the invention when read in conjunction with the accompanying drawings, in which like reference characters designate like or corresponding parts throughout the several views, and wherein.

DESCRIPTION OF THE PREFERRED EMBODIMENTS

Figure 1:
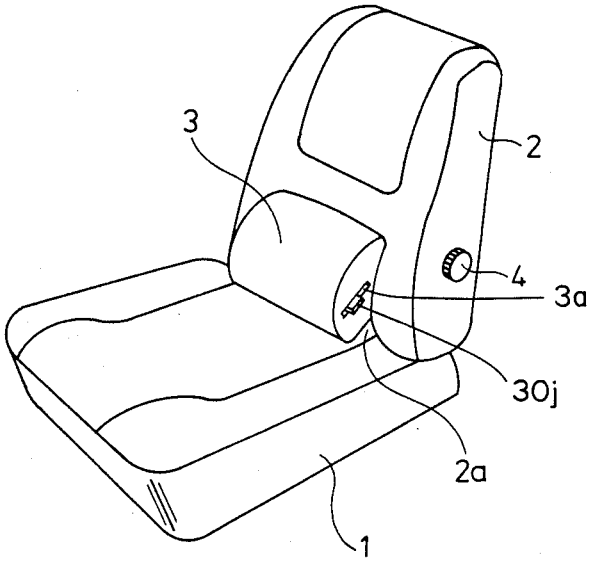
FIG. 1 is a perspective view of an overall arrangement of a seat constructed in accordance with an embodiment of the present invention.

Referring now to FIG. 1, a description will be given of an overall arrangement of a seat in accordance with an embodiment of the present invention. A space **2*a* is formed within a lower portion of a seat back 2 connected to a seat cushion 1, a hip support 3 being disposed within this space 2*a*. An operation handle 4 is designed to adjust the hip support in a back and forth mode. A support board which will be described later is provided within the hip support 3, and a lever 30*j*** is a part of this support board and is designed to adjust the vertical movement of the support board.

Figure 2:
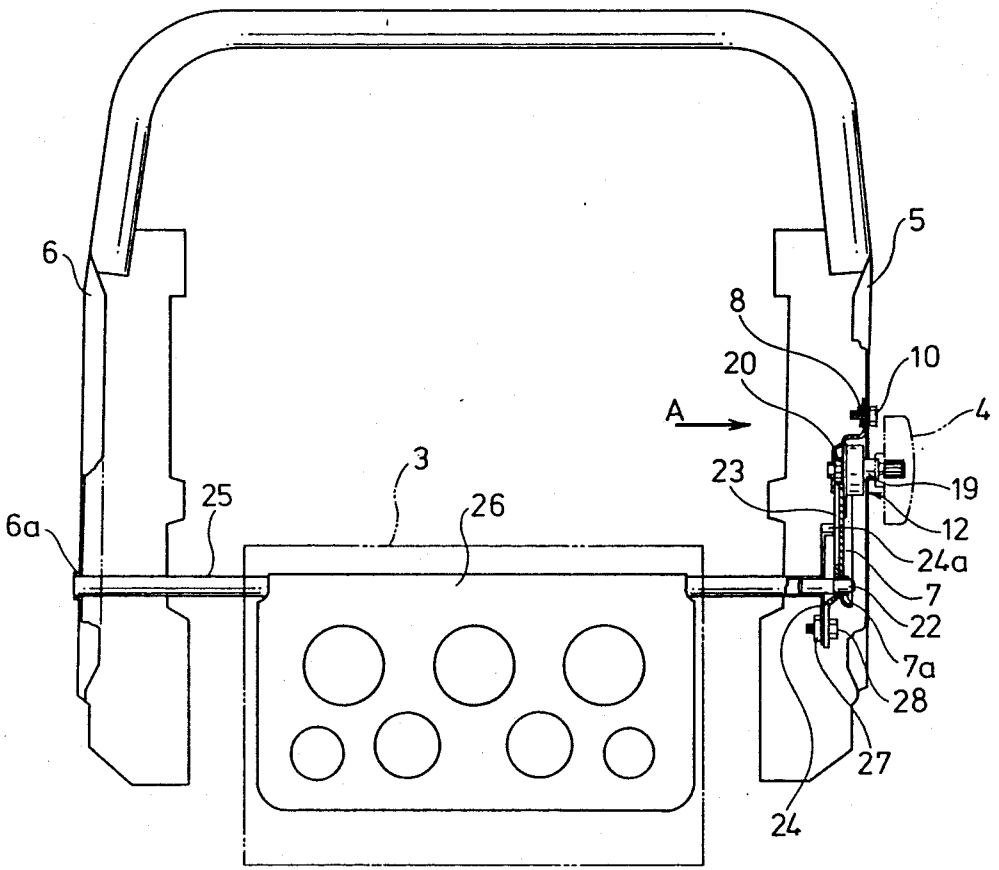
FIG. 2 is a partially cut-away front elevational view illustrating an essential portion of the seat of FIG. 1.
Figure 3:
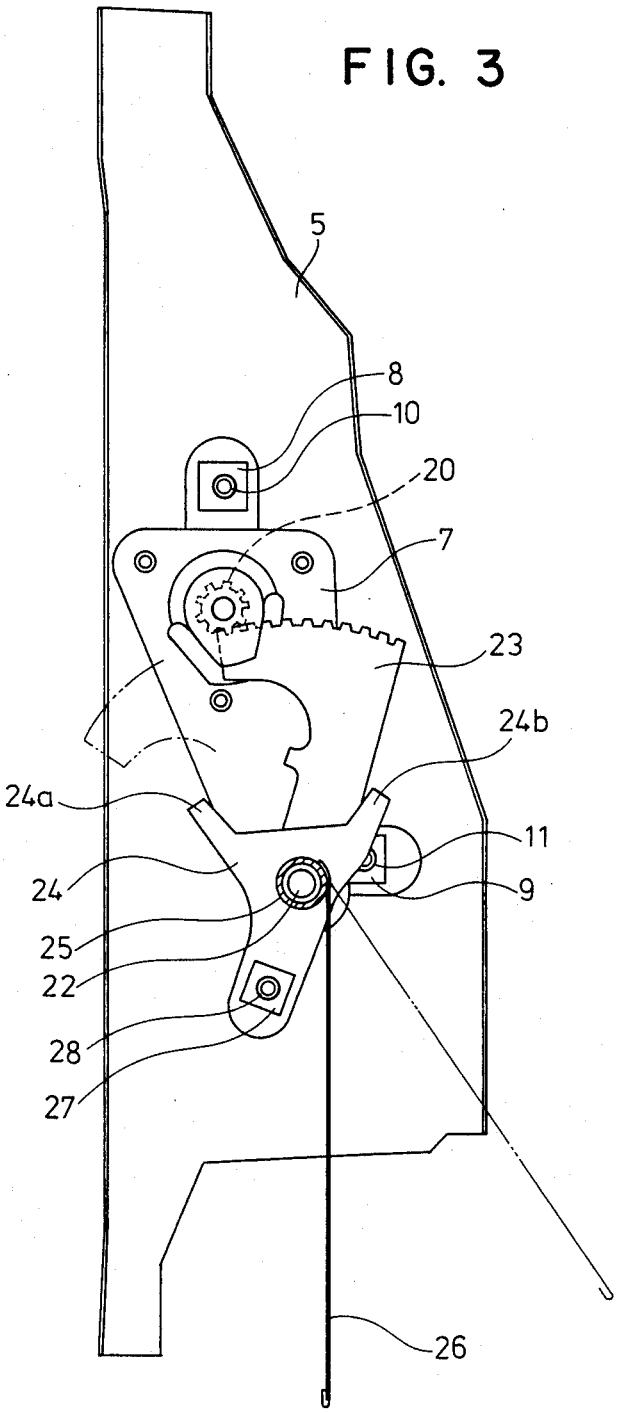
FIG. 3 is a view taken in the direction of the arrow A shown in FIG. 2.
Figure 4:
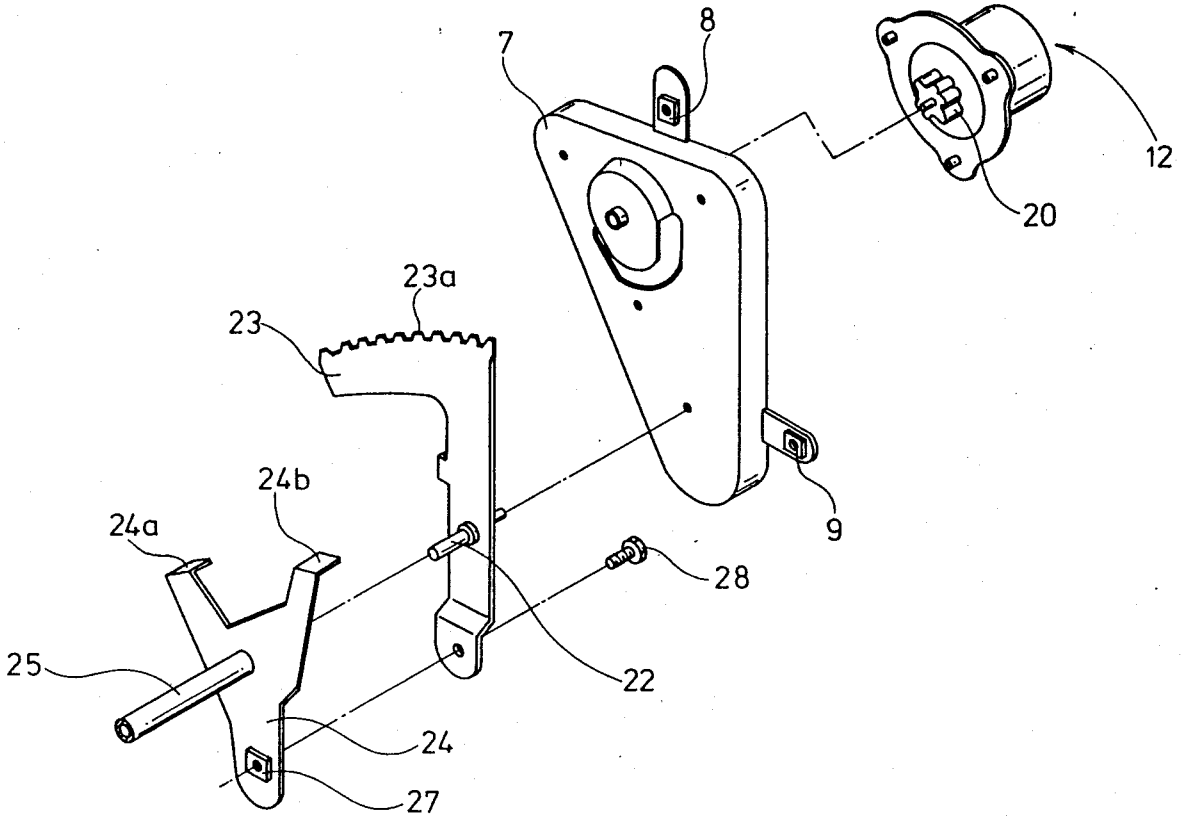
FIG. 4 is an exploded perspective view illustrating an essential portion of the mechanism shown in FIG. 3.

Referring now to FIGS. 2–4, a description will be given of a mechanism for adjusting the position of the hip support 3 in the back and forth mode. Side frames 5, 6 are respectively provided upon oppositely disposed side portions of the seat back 2. A baseplate 7 is attached to one side frame 5. The attachment of the baseplate 7 is effected by causing bolts 10, 11 to threadingly engage with weld nuts 8, 9 welded onto the baseplate 7, respectively, in such a manner as to clamp the side frame 5. A brake mechanism 12 is attached to the baseplate 7.

Figure 5:
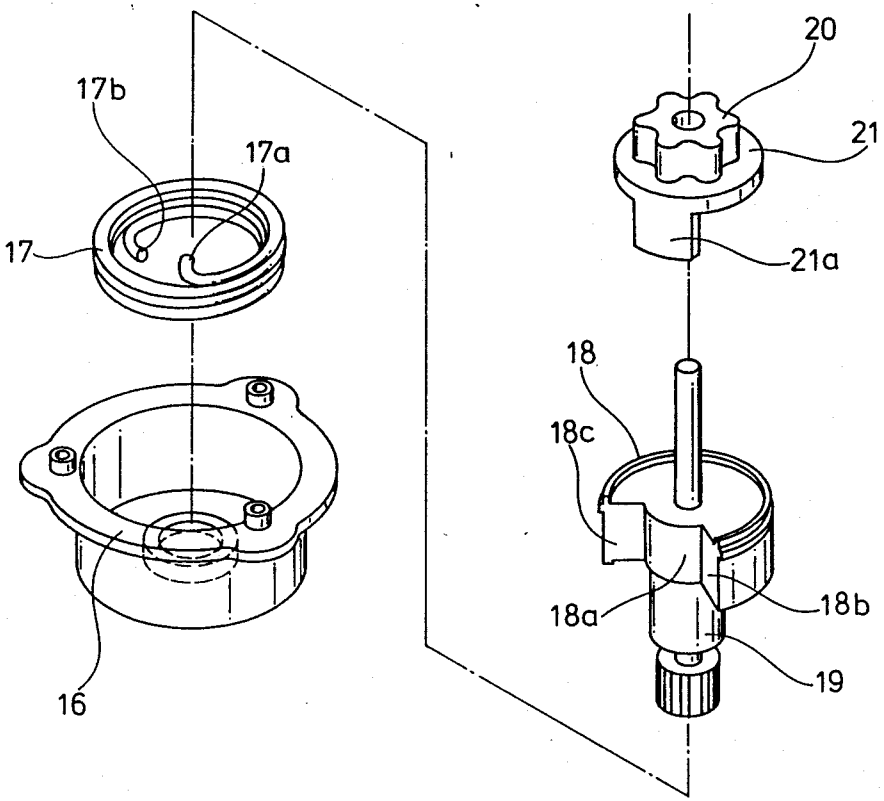
FIG. 5 is an exploded perspective view illustrating a brake mechanism shown in FIG. 2.

A description will now be given of the brake mechanism 12 with reference to FIGS. 5–7. A torsion spring 17 is disposed inside a brake housing 16 which is secured to the baseplate 7, in such a manner as to be brought into pressure contact with an inner wall of the brake housing 16. A core 18 provided with a notch 18*a* is pivotably disposed inserted inside the torsion spring 17. In addition, a handle shaft 19 upon which the operation handle 4 is mounted is integrally secured to this core 18. Furthermore, a pawl portion 21*a* of a stopper plate 21 integrally formed with a pinion 20 is inserted within the space of the notch 18*a* of the core 18 between hook portions 17*a*, 17*b* of the torsion spring 17 in such a manner as to be pivotable about the handle shaft 19.

Figure 6:
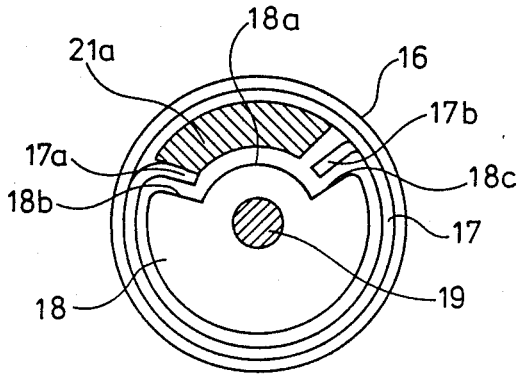
FIGS. 6 and 7 are diagrams illustrating the operation of the brake mechanism shown in FIG. 5.
Figure 7:
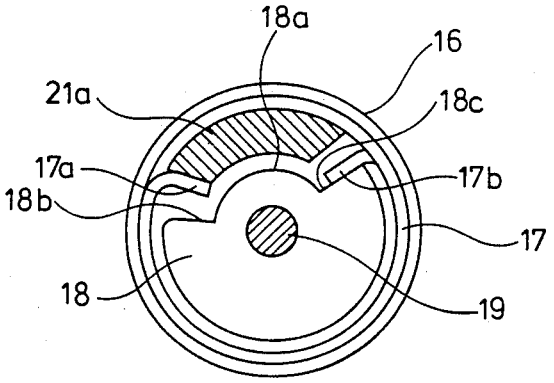

Accordingly, when a rotational force is applied from the pinion 20 side, the pawl portion 21*a* is brought into contact with the hook portion 17*a* or 17*b* of the torsion spring 17 and engages the same, as shown in FIG. 6, so as to act in such a manner as to expand the outside diameter of the torsion spring 17. For this reason, the pressure contacting or engaging force acting between the torsion spring 17 and the brake housing 16 increases, with the result that the hook portions 17*a*, 17*b* do not move, thereby preventing the rotation of the pinion 20. Meanwhile, when an operating force is applied from the operation handle 4 (handle shaft 19) side, since the hook portion 17*a* or 17*b* of the torsion spring 17 is subjected by means of a side end portion 18*b* or 18*c* of the core 18 to a force acting in the direction of contracting the outside diameter of the torsion spring 17, as shown in FIG. 7, the pressure-contacting force acting between the torsion spring 17 and the brake housing 16 decreases. This allows the rotation of the handle shaft 19 to be achieved, and the torsion spring 17 rotates as a result of being pushed by means of the handle shaft 19 and core 18, with the result that the pawl portion 21*a* by pivots as a result of being engaged by means of the hook portion 17*a* or 17*b* of the torsion spring 17. Hence, the pinion 20 also rotates.

Referring back to FIGS. 2–4, a bore 7*a* is provided within a lower portion of the baseplate 7 by means of burring operation. A small-diameter portion of a stepped shaft 22 is pivotably disposed within this bore 7*a*. A driven gear 23 is secured to this small-diameter portion of the stepped shaft 22 and meshes with the pinion 20.

A link plate 24 is loosely disposed upon a large-diameter portion of the stepped shaft 22, and a pair of stopper arms 24*a*, 24*b* which are respectively capable of engaging opposite side surfaces of the baseplate 7 are formed at one pivotable end portion of the link plate 24. A rod 25 is pivotably disposed between the side frames 5, 6. In other words, one end of the rod 25 is loosely engaged with the large-diameter portion of the stepped shaft 22, while the other end thereof is loosely disposed within a bore 6*a* provided within the side frame 6 by means of a burring operation. The end surface of this rod 25 on the system defined by means of side of the side frame 5 is secured to the link plate 24. In addition, an intermediate portion of the rod 25 is disposed within the space 2*a* provided within the seat back 2, a support plate 26 constituting a core portion of the hip support 3 being secured to this intermediate portion of the rod 25.

A weld nut 27 is secured to the other pivotable end portion of the link plate 24. This pivotable end portion of the link plate 24 and the pivotable end portion of the driven gear 23 are connected to each other by means of a bolt 28 which is threadingly engaged with the weld nut 27 in such a manner as to clamp the driven gear 23 therebetween.

Figure 8:
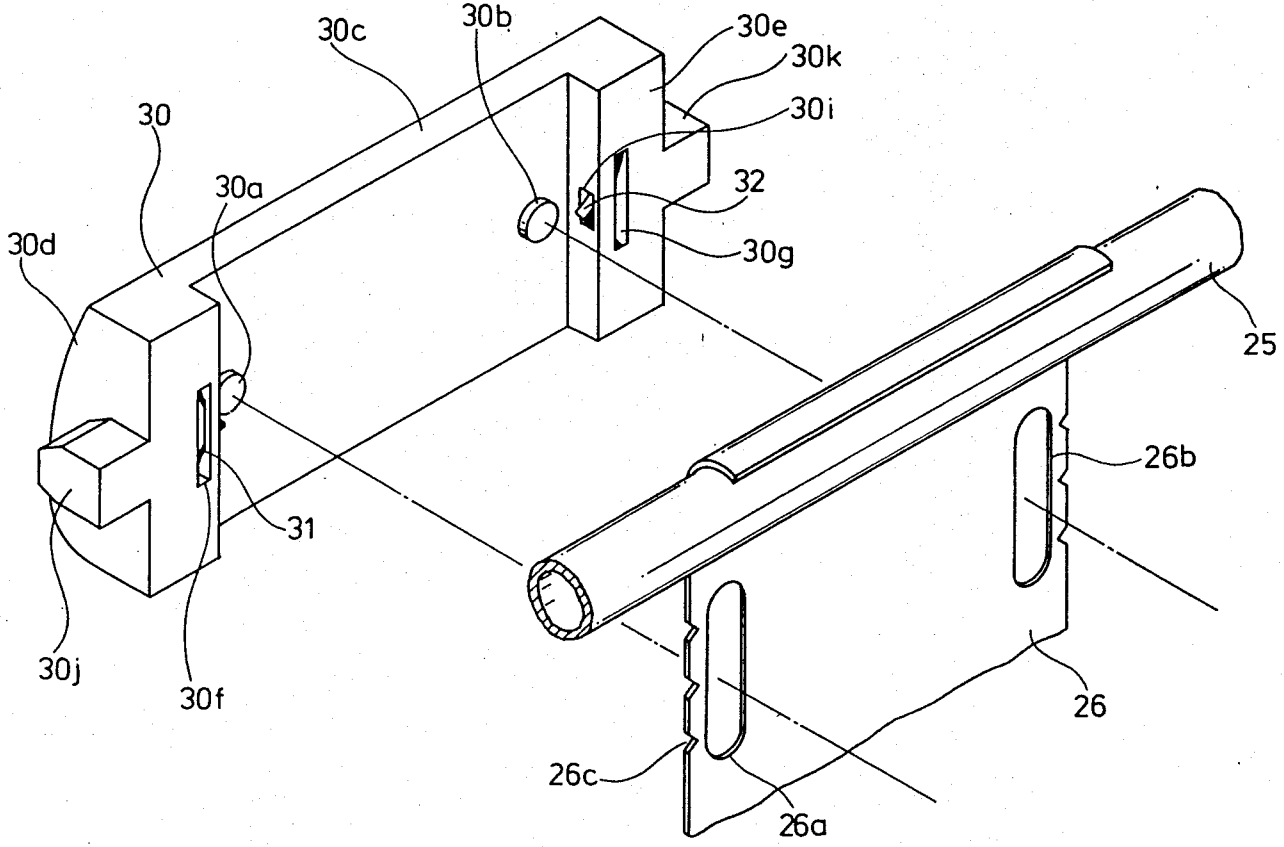
FIG. 8 is an exploded perspective view illustrating an arrangement of a support plate and its peripheral portions.

In addition, as shown in FIG. 8, two vertically extending slots 26*a*, 26*b* are provided within the support plate 26, and notches 26*c* are provided upon side portions thereof. A support board 30 is attached to the support plate 26 and is designed to engage the occupant's hip region within the vicinity of the third to fifth lumbar vertebrae. This support board 30 comprises a main body 30*c* disposed toward the front surface of the support plate 26 and side portions 30*d*, 30*e* which are disposed toward the opposite sides of the support plate 26. Projections 30*a*, 30*b* respectively adapted to guide the support board 30 vertically as a result of being engaged with the two slots 26*a*, 26*b* are provided upon the main body 30*c*. In addition, spring setting bores 30*f*, 30*g* are provided within side portions 30*d*, 30*e* of the support board 30. Windows, 30are respectively provided within portions of the side portions 30*d*, 30*e* in such a manner as to face the support plate and the spring setting bores 30*f*, 30*g*. Substantially L-shaped leaf springs 31, 32 are disposed within the spring setting bores 30*f*, 30*g*. Central bent portions of the leaf springs 31, 32 respectively project from the windows, 30*i* and are engageable with the notches 26*c* of the support plate 26. Accordingly, by virtue of the retaining mechanism making use of engagement between the leaf springs 31, 32 and the notches 26*c*, the natural descent of the support board 30 is prohibited making it possible to retain the support board 30 at a given elevation. In addition, levers 30*j*, 30*k* projecting outwardly of hip support 3 through means of slits 3*a* (see FIG. 1) provided within the sides of the hip support 3 are formed upon the side portions 30*d*, 30*e* of the support board. These levers or projections 30*j*, 30*k* are designed to impart an operating force to the board 30 so as to be capable of moving the support board 30 vertically.

The operation of the above-described arrangement will be described hereinunder. FIGS. 2 and 3 illustrate the state in which the stopper arm 24*a* of the link plate 24 abuts the side surface of the baseplate 7, and the hip support 3 is accommodated within the innermost portion of the space 2*a* of the seat back 2. In this state, if the operation handle 4 is rotated so as to cause the pinion 20 to rotate clockwise, as viewed in FIG. 3 by means of the brake mechanism 12, the driven gear 23 meshing with the pinion 20 rotates counterclockwise, as viewed in FIG. 3. In conjunction with the rotation of the driven gear 23, the link plate 24 with its pivotable end portion connected to the driven gear 23 also pivots in the counterclockwise direction, as viewed in FIG. 3, about the stepped shaft 22. As the link plate 24 pivots, the rod 25 secured to the link plate 24 also pivots in the counterclockwise direction, as viewed in FIG. 3, which, in turn, causes the support plate 26 to pivotably move in the direction of projecting from the seat back 2, thereby causing the hip support 3 to project forwardly of from the space 2*a* of the seat back 2. This movement is allowed until the stopper arm 24*b* of the link plate 24 is brought into contact with the side surface of the baseplate 7 (that is, until the driven gear 23 and the support plate 26 move to the positions indicated by means of the two-dotted chain line in FIG. 3). It goes without saying that if the operation handle 4 is rotated in the reverse direction, the hip support 3 returns to its retracted position within the space 2*a* of the seat back 2. The position thus adjusted is held by virtue of the action of the above-described brake mechanism 12 unless the operation handle 4 is operated.

When the vertical position of the support board 30 is to be adjusted, an upward (or downward) operating force is applied to the levers **30*j*, 30*k* projecting outwardly beyond the outer surface layer of the hip support 3. Then, the leaf springs 31, 32 are subjected to elastic deformation, which in turn causes engagement between the leaf springs 31, 32 and the notches 26*c* to be released, thereby allowing the support board 30 to be moved. When the support board 30 has moved by means of a predetermined amount, the leaf springs 31, 32 engage with the next-stage notches 26*c*. If the operation is stopped at this juncture, that position is held, and the natural descent of the support board 30** is prohibited. As a result, a newly adjusted position can be obtained.

In accordance with the above-described arrangement, since the support board 30 for engaging the occupant's hip region within the vicinity of the vertebrae third to fifth lumbar can be moved vertically, it is possible to obtain favorable support for the hip region of the seat occupant. In addition, since it is possible to adjust the back-and-forth position of the hip support 3 as the occupant operates the operation handle 4 while being seated, it is possible to obtain support of the hip region with a desired amount of rigidity.

It should be noted that the present invention is not confined to the above-described embodiments, and various modifications are possible without departing from the spirit of the invention which is defined solely by the accompanying claims. For instance, although in the above-described embodiment the stopper arms **24*a*, 24*b* are provided upon the link plate 24, the stopper arms 24*a*, 24*b* may be provided upon the driven gear 23. In addition, it is possible to use a stepless shaft instead of the stepped shaft 22. Furthermore, welding or similar methods may be used as the method of connecting the rotating end portion of the link plate 24 to the rotating end portion of the driven gear 23. Moreover, the leaf springs 31, 32 may be provided upon the support plate 26, while the notches 26*c* may be provided on the support board 30**.

What is claimed is:

1. A seat, comprising:

a seat cushion;

a seat back connected to said seat cushion, wherein a space is formed within a lower portion of said seat back;

a rod rotatably interposed between opposed side frames of said seat back;

a hip support disposed within said space provided within said seat back;

an operation handle provided upon either one of said side frames and adapted to rotate said rod by means of a brake mechanism interposed between said operation handle and said rod;

a pinion, operatively connected to said rod, to which the rotation of said operation handle is transmitted by means of said brake mechanism;

said hip support including a support plate secured upon an intermediate portion of said rod and disposed inside of said hip support;

a support board mounted upon said support plate so as to be vertically movable therealong between a plurality of selective positions; and retaining means defined between said support board and said support plate for retaining said support board at a selected one of said selective positions.

2. A seat according to claim 1, wherein said retaining means comprises:

a multiplicity of notched defined upon a side portion of said support plate;

a substantially L-shaped leaf spring mounted upon said support board, a bent portion of said leaf spring being adapted to be engaged with one of said multiplicity of notches; and a projection provided upon said support board and projecting outwardly through a side of said hip support so as to be capable of imparting an operating force to said support board so as to move said support board between selected ones of said selective positions.

3. A seat according to claim 1, wherein the rotation of said operation handle is imparted to said rod by means of a driven gear provided rotatably on the same axis of said rod on one side frame side and adapted to mesh with said pinion, and a link plate which is secured to an end portion of said rod and wherein a rotating end portion of said link plate is operatively engaged with a rotating end portion of said driven gear.

4. A seat according to claim 3, further comprising:

a baseplate fixedly secured to one of said side frames; and said brake mechanism is attached to said baseplate.

5. A seat according to claim 4, wherein said brake mechanism comprises:

a brake housing attached to said baseplate;

a torsion spring disposed inside said brake housing in such a manner as to be brought into pressure contact with an inner wall of said brake housing;

a core secured integrally to a handle shaft on which said operation handle is mounted, said core being provided with a notch and being rotatably inserted inside said torsion spring;

a stopper plate formed integrally with said pinion and having a claw portion rotatably inserted within the space of said notch of said core between hook portions of said torsion spring in such a manner as to be rotatable about said handle shaft.

6. A seat according to claim 5, wherein:

a pair of stopper arms, for abutting against side surfaces of said baseplate, are provided upon said rotating end of said link plate so as to restrict the range of movement of said link plate.

7. A seat as set forth in claim 5, wherein:

said brake mechanism is a one-way type brake mechanism which permits rotation of said operation handle, said pinion, and said driven gear from a core side of said brake mechanism, but prevents rotation of said operation handle, said pinion, and said driven gear from a pinion side of said brake mechanism.

8. A seat as set forth in claim 3, wherein:

said driven gear comprises a sector gear.

9. A seat as set forth in claim 1, wherein:

said operation handle is disposed at a position which is external to a side portion of said seat back of said seat.

10. A seat as set forth in claim 1, further comprising:

vertically oriented slot means defined within said support plate;

projection means provided upon said support board and disposed within said slot means of said support plate for guiding said support board upon said support plate during vertical movement of said support board relative to said support plate when said support board is moved between said selective positions.

* * * * *